US005390415A

United States Patent [19]

Momose

[11] Patent Number: 5,390,415

[45] Date of Patent: Feb. 21, 1995

[54] ELECTRIC RAZOR

[75] Inventor: Kazuhiro Momose, Nagano, Japan

[73] Assignee: Izumi Products Company, Nagano, Japan

[21] Appl. No.: 163,380

[22] Filed: Dec. 7, 1993

[30] Foreign Application Priority Data

Jan. 8, 1993 [JP] Japan ..... 5-002891[U]

[51] Int. Cl.[6] ..... B26B 19/38

[52] U.S. Cl. ..... 30/41; 30/43.92

[58] Field of Search ..... 30/41, 43.91, 43.92

[56] References Cited

U.S. PATENT DOCUMENTS 1,999,972 4/1935 Becker ..... 30/305 X
2,093,762 9/1937 Kroner ..... 30/41
3,068,568 12/1962 Schnapp ..... 30/43.92 X
3,447,241 6/1969 Moeckl ..... 30/41
3,947,961 4/1976 Meyer ..... 30/41
4,012,837 3/1977 Ascoli ..... 30/43.92 X
4,031,617 6/1977 Tanaka et al. ..... 30/43.92 X

*Primary Examiner*—Eugenia Jones
*Attorney, Agent, or Firm*—Koda and Androlia

[57] ABSTRACT

An electric razor with a cleaning cover fitted on the inner cutter. The cleaning cover has slits which correspond in position to the blades of the inner cutter, and the blades of the inner cutter can pass through the slits when the cleaning cover is fitted on the inner cutter; and once the cover is fitted on the inner cutter, the surface of each blade is in contact with the inner surfaces of the slits. The razor is used with the cleaning cover on, and when after shaving the cleaning cover is lifted, the facial hair that has been cut and is adhering to the blades of the inner cutter are removed by the cleaning cover, thus cleaning the inner cutter.

5 Claims, 1 Drawing Sheet

ELECTRIC RAZOR

BACKGROUND OF THE INVENTION

1. Field of the Invention

The present invention relates to an electric razor and more particularly to an electric razor with an inner cutter cleaning means.

2. Prior Art

One type of electric razor cuts the whiskers or facial hair by an inner cutter that makes a reciprocating movement relative to an outer cutter. In this type of electric razor, the inner cutter has a plurality of half-moon- or arc-shaped blades lined up in a row at equal intervals. The inner cutter makes a continuous reciprocating movement in a direction in which the blades are lined up, and the whiskers entering through the slits of the outer cutter are sheared by the two cutters.

The whiskers sheared by the electric razor accumulate in an internal space of the razor that is covered by the outer cutter and houses the inner cutter. When the sheared whiskers accumulate excessively inside the internal space, the sheared whiskers offer resistance to the movement of the inner cutter. The result is a great drop in cutting performance. Thus, the internal space and the cutters need to be cleaned periodically by removing the Whiskers with, for example, a cleaning brush.

However, cleaning with a brush involves problems. The sheared whiskers adhere to the inner cutter, and since the spaces between the arc-shaped blades of the inner cutter are small, it is not easy to brush off the whiskers from the spaces. It is particularly very difficult to clean the inner cutter when the whiskers adhere to the blade with grease.

SUMMARY OF THE INVENTION

Accordingly, the primary object of the present invention is to provide an electric razor that can achieve easy and reliable removal of whiskers adhering to the surfaces of the blades of the inner cutter.

In order to solve the problems, the structure as follows is utilized in the present invention: The electric razor of the present invention that cuts whiskers via an inner cutter that moves relative to an outer cutter includes a detachable cleaning cover that has slits such that each of the slits positionally corresponds to each one of the blades of the inner cutter. The cleaning cover is fitted on the inner cutter; and when the cleaning cover is fitted, each blade of the inner cutter passes through each slit of the cleaning cover, and the inner surfaces of the slit comes into a tight contact with the surface of the blade.

If the inner cutter has a plurality of half-moon- or arc-shaped blades which are installed in a row at equal intervals on a half-cylindrical base, the cleaning cover is shaped in a half-cylinder, and the slits are opened in this half-cylinder cleaning cover at the same equal intervals as the blades of the inner cutter.

Thus, the cleaning cover has blade slits and is removably fitted on the inner cutter. The blade slits are opened so as to positionally correspond to the blades of the inner cutter. Accordingly, when the cleaning cover is fitted on the inner cutter, the individual blades of the inner cutter pass through each blade slit and both surfaces of each of the blades come in contact with the inner surfaces of each blade slit. No space remains between the blade and the blade slits, and they are in tight contact together. As a result, when the cleaning cover is removed from the inner cutter after shaving, the inner surfaces of the blade slits slide over the surfaces of the blades, thus dragging out the whiskers from the surfaces of the blades of the inner cutter.

DETAILED DESCRIPTION OF THE INVENTION

One embodiment of the present invention will be described below in detail with reference to the accompanying drawings. The electric razor in this embodiment includes an inner cutter that has a plurality of half-moon- or arc-shaped blades arranged in a row at equal intervals on a half-cylindrical blade base. The inner cutter, when installed in a razor, makes a continuous reciprocating movement in a direction of arrow R in which the blades are lined up. The whiskers penetrating the outer cutter are cut by the inner and outer cutters.

Figure 1:
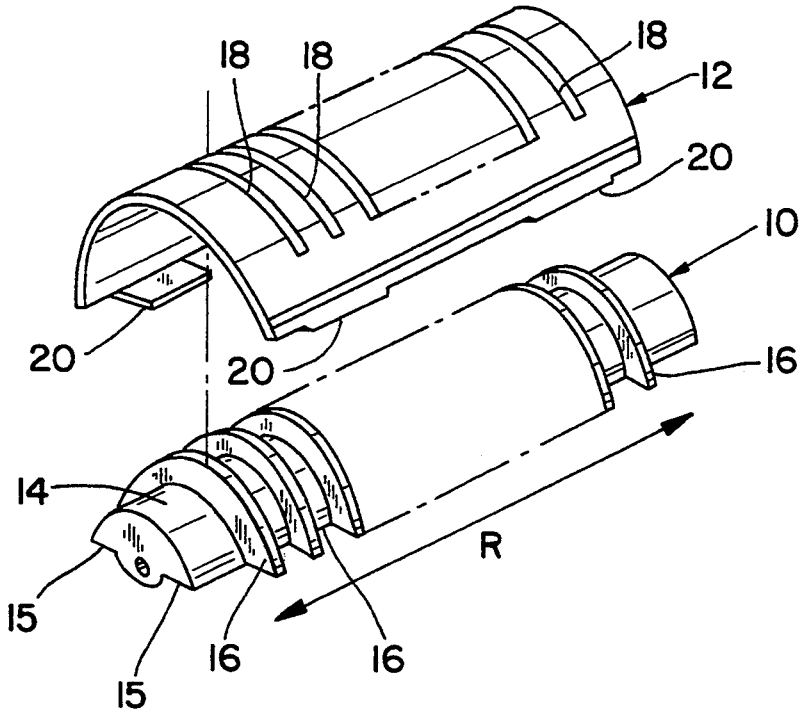
FIG. 1 illustrate a positional relationship between the inner cutter and the cleaning cover used in one embodiment of the present invention.
Figure 2:
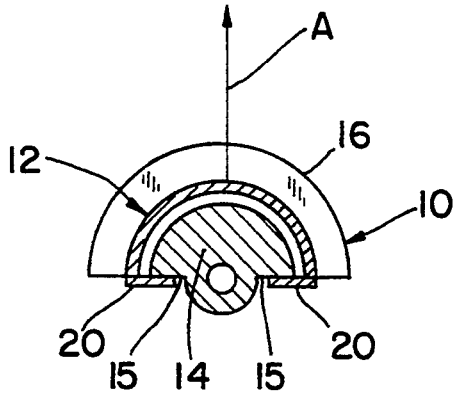
FIG. 2 is a vertical cross-section showing the cleaning cover fitted on the inner cutter.

FIG. 1 shows the inner cutter 10 and a cleaning cover 12 of the embodiment. FIG. 2 is a cross-sectional side view showing these two components fitted together.

The inner cutter 10 comprises a blade base 14 and blades 16 provided thereon. The blade base 14 is axially a half cylinder. In other words, the inner cutter 10 is half-moon- or arc-shaped in cross section, and a plurality of blades 16 are provided thereon. The blades 16 are plates of a half-moon shape or an arc shape, and each one of the blades 16 has a cutting edge on the outer circumference. These blades 16 are installed at short equal intervals on the circumference of the outwardly curved or projected surface of the blade base 14. The blades 16 are lined up in the direction of the length of the blade base 14. In other words, the blades 16 are lined up in the direction of arrow R in which the inner cutter 10 makes it reciprocating movement.

The cleaning cover 12 is obtained by molding a thin metal plate, synthetic resin plate, or other materials which have elasticity, into the shape of a half-cylinder so that it can snugly fit on the upper half of the inner cutter 10. The cleaning cover 12 is provided with a plurality of blade slits 18 that are equal in number to the blades 16 of the inner cutter 10. The blade slits 18 are opened radially and lined up in a row side by side along the length of the cleaning cover 12 at the same intervals as the blades 16 of the inner cutter 10. The width of each blade slit 18 is the same as or slightly smaller than the thickness of each blade The thus structured cleaning cover 12 is fitted on the upper half of the inner cutter 10. When it is fitted, the corresponding blades of the inner cutter 10 pass through the blade slits 18 with both side surfaces of each one of the blades in tight contact with the inner surfaces of each blade slit 18.

Four hooks 20 extend inwardly from the four bottom corners of the cleaning cover 12. When the cleaning cover 12 is fitted on the inner cutter 10, the hooks 20 make an elastic contact with the bottom flat surfaces 15 of the blade base 14 of the inner cutter 10 so that the cleaning cover 12 is securely fastened to the inner cutter 10.

The hooks 20 on one side of the cleaning cover 12 can be formed in a hinged fashion. In this case, the cleaning cover 12 is fitted on and removed from the inner cutter 10 using the hinged hooks together with the elastic deformation of the cleaning cover 12 with the hooks 20 of the other side.

The cleaning cover 12 is fitted on the inner cutter 10 as shown in FIG. 2.

When the electric razor is used, the cover 12 is on the inner cutter 10 as seen in FIG. 2. When the whiskers are cut, they accumulate in the razor's internal space (not shown) which houses the inner cutter 10 and is covered with the outer cutter (not shown). The cut whiskers also adhere to the inner cutter 10. When the cut whiskers accumulate in excessive amounts inside the internal space, the whiskers, as described above, offer resistance to the movement of the inner cutter 10, and there is a considerable drop in cutting performance. Accordingly, it is necessary to clean the internal space and remove the whiskers.

The whiskers not adhering to the inner cutter 10 are cleaned by brush, etc. as seen in the conventional electric razors. The whiskers adhering to the inner cutter 10, particularly those sticking on both side surfaces of each blade can be removed by brush; but a complete removal of the cut whiskers is performed by the cleaning cover 12.

In particular, the hooks 20 of the cleaning cover 12 are first deformed elastically and removed from the blade base 14. After the hooks 20 have been removed, the cleaning cover 12 is moved in the direction of arrow A in FIG. 2 and is separated from the inner cutter 10. When the cover 12 is being separated, both side surfaces of each blade 16 of the inner cutter 10 are in constant contact with the inner surfaces of each blade slits 18. As a result, the inner surfaces of each blade slit 18 slide over both side surfaces of each blade 16 to which whiskers are adhering, and the inner surfaces of the blade slit 18 drags the adhering whiskers out with them. This dragging force is considerably greater than the dragging force of a brush. Thus, the whiskers and even the whiskers adhering with a strong adhesive force due to grease in the narrow spaces between the adjacent blades 16 can easily be removed in a one-touch operation such as removing the cleaning cover 12 from the inner cutter 10.

Various aspects of the embodiment of the present invention are described above. However, the present invention is not limited to the embodiment above. It goes without saying that numerous modifications are obtainable within the spirit of the invention.

As seen from the above, when the electric razor is used, the cleaning cover is on the inner cutter. The cleaning cover has blade slits which are opened at positions corresponding to the blades of the inner cutter, and the individual blades of the inner cutter pass through the slits with both surfaces of each of the blades in contact with the inner surfaces of each of the blade slits when the cleaning cover is fitted on the inner cutter. Accordingly, when the cleaning cover is removed from the inner cutter after shaving, the inner surfaces of the blade slits of the cleaning cover slide over the surfaces of the blades, thus dragging out the whiskers adhering to the blades. Since this dragging force is considerably greater than that of a cleaning brush, even the whiskers adhering with a strong adhesive force by, for example, grease in the narrow spaces between adjacent blades, can be easily and reliably removed via a one-touch motion.

I claim:

1. An electric razor in which whiskers are sheared by an inner cutter comprising a plurality of blades that move relative to an outer cutter, said razor comprising a cleaning cover fitted on said inner cutter, said cleaning cover having a plurality of blade slits, said blades of said inner cutter extending through said blade slits pass with both opposing surfaces of each of said blade slits in contact with individual ones of said blades when said cleaning cover is fitted to said inner cutter, and said blade slits being positioned corresponding to said blades.

2. An electric razor according to claim 1, wherein said plurality of blades comprise half-moon-shaped blades which are installed in a row at equal intervals, said cleaning cover is formed in a shape of a half-cylinder, and the plurality of said blade slits are formed at equal intervals equal to the equal intervals of said blades.

3. An electric razor according to claim 1, wherein said inner cutter makes a reciprocating movement to cut hair and, said cleaning cover is in a shape to snugly fit on said inner cutter.

4. An electric razor according to claim 3, wherein said cleaning cover is axially a half-cylinder shape with said slits opened radially and arranged in a row for substantially an entire length of said cleaning cover.

5. An electric razor according to claim 4, further comprising hooks provided at four bottom corners of said cleaning cover for securely fitting said cleaning cover to said inner cutter.

* * * * *